US006082519A

United States Patent [19]

Martin et al.

[11] Patent Number: 6,082,519

[45] **Date of Patent: *Jul. 4, 2000**

[54] COIN BIN WITH LOCKING LID

[75] Inventors: Doug Martin, Woodinville; Scott Scherer, Seattle; Russell Borgmann, Kent, all of Wash.

[73] Assignee: Coinstar, Inc., Bellevue, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 08/883,776

[22] Filed: Jun. 27, 1997

[51] Int. Cl.[7] ..... G07F 9/06

[52] U.S. Cl. ..... 194/350; 232/15

[58] Field of Search ..... 194/350; 232/7, 232/12, 15, 16; 70/387, 57.1

[56] References Cited

U.S. PATENT DOCUMENTS

| | | | |
|---|---|---|---|
| 379,811 | 3/1888 | Reimann | 232/15 |
| 382,864 | 5/1888 | Claspy | 232/15 |
| 3,066,858 | 12/1962 | Tipton | 232/16 |
| 3,416,337 | 12/1968 | Hutchins | 70/284 |
| 3,903,721 | 9/1975 | Aaron | 70/423 |
| 4,380,316 | 4/1983 | Glinka et al. | 232/16 |
| 4,534,492 | 8/1985 | Schwarzli | 221/203 |
| 4,964,495 | 10/1990 | Rasmussen | 194/344 |
| 5,097,934 | 3/1992 | Quinlan | 194/200 |
| 5,390,515 | 2/1995 | Essick | 70/57.1 X |
| 5,564,546 | 10/1996 | Molbek et al. | 194/216 |
| 5,619,932 | 4/1997 | Efland et al. | 194/350 |
| 5,620,079 | 4/1997 | Molbek | 194/217 |

FOREIGN PATENT DOCUMENTS

| | | | |
|---|---|---|---|
| 0 455 100 A2 | 4/1991 | European Pat. Off. | G07F 9/06 |
| 807880 | 1/1959 | United Kingdom . | |
| 1331936 | 9/1973 | United Kingdom | 194/350 |
| 2 079 846 | 1/1982 | United Kingdom | G07F 9/06 |
| 2 130 299 | 5/1984 | United Kingdom | G07F 9/06 |

*Primary Examiner*—F. J. Bartuska
*Attorney, Agent, or Firm*—Sheridan Ross P.C.

[57] ABSTRACT

A bin for use in a coin handling device for receiving coins through an opening in the bin is provided with a cover movable from an open position to a closed position. The cover is configured to couple with a key mounted in the coin handling device such that when the bin is inserted into the coin handling device, the key automatically unlocks and opens the cover. When the bin is withdrawn from the coin handling device, the opening is automatically covered and the cover is automatically locked in the closed position.

46 Claims, 7 Drawing Sheets

COIN BIN WITH LOCKING LID

FIELD OF THE INVENTION

The present invention relates to a bin with a self-locking hatch and in particular to a bin usable with a coin counting device which is automatically opened and unlocked and positioned in the coin counting device and is automatically closed and locked upon removal from the coin counting device.

BACKGROUND OF THE INVENTION

A number of coin counting or coin handling devices are configured to receive coins, or to work in cooperation with a device for receiving coins, after they have been counted or handled. For example, the coin counting device may be configured to output counted coins to a tray, bin, box, bag, trolley or similar device. Some coin handling devices are configured to output coins to two or more difference receptacles, such as to place different coin denominations in different bags or to distribute coins to two or more receptacles so as to avoid a single receptacle which is heavier than desired when loaded.

A number of coin handling devices are configured to facilitate removal of coins from the coin handling device, e.g. for deposit in a bank, reuse elsewhere, further counting or other handling, sorting, and the like. Conveniently, coin handling devices may be configured to permit easy removal of a coin bin, bag or other receptacle after it has been fully or partially filled with coins. Such removal of a bin, bag or other coin receptacle presents a number of handling, security and other problems. Since the receptacle, during use, has at least one opening through which coins are received, upon removal of the receptacle there is a potential for pilfering or other unauthorized removal of coins from the receptacle, and a potential for spillage or other unintentional loss of coins. In some situations, bins or bags may be configured so that personnel removing the receptacle may manually close the opening. However, since this procedure relies on the memory, diligence and honesty of the person removing the receptacle, there is a potential of personnel to forget or otherwise fail to properly close the receptacle, leading to loss of coins. In some cases, a receptacle may be configured to permit an opening to be closed but may not provide for automatic locking of a receptacle, potentially permitting opening of a closed but unlocked receptacle. Accordingly, there is a need for a coin receptacle which, upon removal from a coin counting device, is automatically closed and locked.

In some situations a coin receptacle may be configured such that manual intervention is required in order to open and/or unlock the receptacle once it is closed or locked. This type of receptacle presents the potential for installing a closed or locked receptacle into a coin handling device which may result in misdirection of counted coins, e.g. onto the floor or the interior of the coin counting device. Accordingly, there is a need for a receptacle configured to automatically unlock and/or open upon insertion into a coin handling device.

In some previous devices, if the cover was closed and locked, it could not thereafter be reopened until the entire lid of the bin was opened, permitting access to the resetting or cocking mechanism of the lock. Accordingly, there was a risk that, owing to personnel forgetfulness, bins could be delivered to coin handling machines in a locked condition and in which the bins could not be unlocked without returning to the central coin processing facility which typically is the only facility able to access the interior of the bin.

Certain coin handling devices are configured to define a specific volume for receiving a coin receptacle. When coin receptacles are configured to use a portion of the interior volume of the receptacle for accommodating closing or locking mechanisms, the volume available for holding coins is accordingly reduced, effectively increasing the frequency with which the coin handling device must be serviced, e.g. for removal of counted coins. Accordingly, it would be useful to provide a coin receptacle which reduces or minimizes the volume devoted to closing or locking mechanisms.

In a typical coin receptacle, coins entering the receptacle are free to rebound off interior receptacle walls or other coins, creating the potential for damaging or jamming any moving parts placed in or exposed to the interior of the receptacle. Accordingly, it would be useful to provide a coin receptacle which minimizes or reduces the moving parts exposed to the interior of the receptacle.

Since coins are relatively dense, a fully-loaded coin bin can have a relatively large mass such as around 500 lbs. (about 200 kg) or more. As the coin receptacles are moved, often using wheels, there is a potential, particularly when receptacles are moved through public areas, for personnel to lose control of the receptacle, potentially causing injury or damage. Accordingly, it would be useful to provide a receptacle which includes one or more wheels for ease of handling but which reduces or eliminates potential for loss of control.

In general, then, it would be useful to provide a coin receptacle which is automatically locked and closed on removal from the coin handling device, automatically opened and unlocked on insertion into the coin handling device, provides for efficient use of volume to permit storage of a large number of coins, and minimizes or reduces potential for jamming or damage of mechanisms. Preferably, such a device is robust, relatively inexpensive to manufacture, install and maintain, such as by using a relatively small number of parts, and in general facilitates removal of coins from the coin handling device in a secure, safe, and inexpensive manner, requiring little attention from service personnel and reducing the potential for loss of coins.

SUMMARY OF THE INVENTION

According to the present invention, the coin receptacle is configured with an opening (through which coins are placed in the receptacle) which is automatically closed and/or locked when the receptacle is removed from the coin handling device and is automatically opened and/or unlocked when the receptacle is inserted into the coin handling device. In one embodiment, a key is mounted in the coin handling device in a position such that, upon insertion of the coin receptacle, the key enters a keyway of the coin receptacle, automatically unlocking and opening a cover which is positioned over the opening of the receptacle. In one embodiment the key and the cover move in a parallel, preferably coplanar fashion through a channel defined by channel rails. The cover includes arms with teeth that engage recesses in the channel for locking the cover in the closed position. The key preferably includes camming surfaces positioned to withdraw the key from the recesses and surfaces to engage the arms of the hatch cover such that, as insertion of the bin causes the key to move through the channel, the key, in turn, causes the cover to move through the channel, uncovering the opening of the bin.

Upon withdrawal of the bin, the key moves through the channel in the opposite direction, drawing the cover through the channel to the closed position and, upon disengagement of the key from the arms of the hatch cover, allowing the arms to resiliently move the teeth back into the channel recesses for locking. Preferably, the mechanism is mounted substantially on an exterior surface of the bin, avoiding undesirable encroachment on the interior volume of the bin and avoiding exposure of moving parts to rebounding coins.

DETAILED DESCRIPTION OF THE PREFERRED EMBODIMENTS

Figure 1:
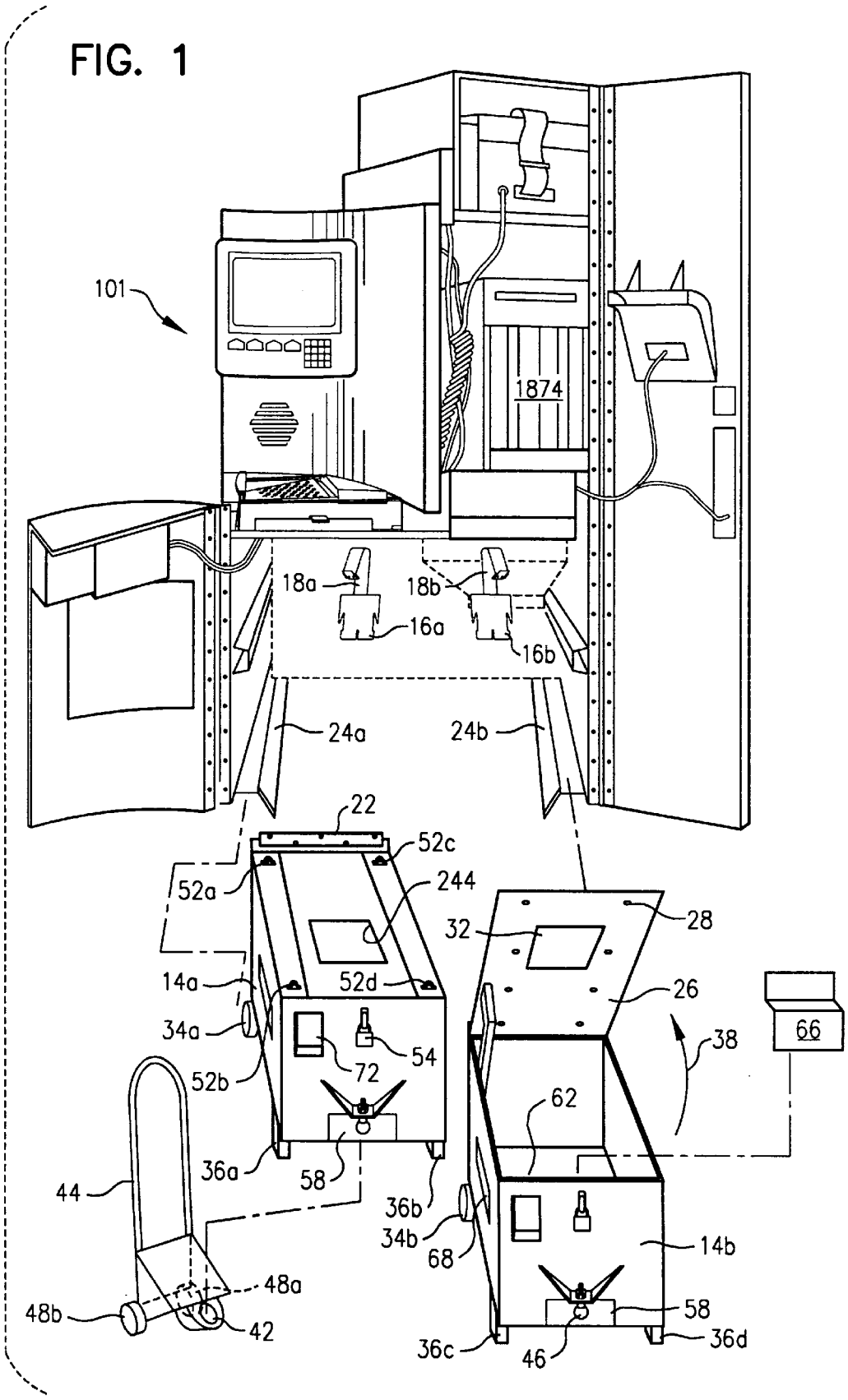
FIG. 1 is a perspective view of a coin handling device with doors that are in an open position and coin bins removed.

FIG. 1 depicts a coin counting device 101 of a type useful in connection with the present invention with doors in an open position to show interior portions thereof. The present invention can be used in connection with a number of coin handling devices, including those described in U.S. Pat. No. 5,564,546 issued Jun. 6, 1994, and PCT/US95/05356 filed May 1, 1995, for Coin Counter/Sorter and Coupon/Voucher Dispensing Machine and Method, both incorporated herein by reference.

In the coin counting device of FIG. 1, the lower portion 12 defines a region for receiving first and second coin receptacles such as bins 14*a*, 14*b*. First and second keys 16*a*, 16*b* are mounted for insertion into keyways of the bins 14*a*, 14*b* as described more fully below. The keys 16*a*, 16*b*, in the depicted embodiment, are mounted on flexible, curved arms 18*a*, 18*b* preferably made of a metal such as spring steel to permit the keys 16*a*, 16*b* a degree of freedom of movement (preferably such as at least four degrees of freedom) to achieve insertion into the keyways of the bins as the bins are inserted into the space 12 despite minor misalignment of the keys 16*a*, 16*b* with the keyways. The keys 16*a*, 16*b* may be made of a number of materials including plastic, metal, fiberglass, ceramic and the like. Preferably the keys 16*a*, 16*b* are made from ABS (abutyl styrene) plastic. Preferably the keys 16*a*, 16*b* and bins 14*a*, 14*b* are configured so that existing coin counting devices can be readily retrofit to accommodate the keys 16*a*, 16*b* and receptacles 14*a*, 14*b*.

Preferably the key, when located in the proper position, is not readily visible in the machine, in order to avoid unauthorized persons being able to deduce the configuration of the key or the operation of the lock from an inspection of the key shape. If desired, the key may be provided with one or more decoy, non-functional shapes to confound attempts to deduce key operation from an inspection of the key.

A number of features can be included to assist in achieving proper insertion of the keys 16*a*, 16*b* to the keyways therein. Preferably, the leading edges of the keys 16*a*, 16*b* are chamfered or beveled. The opening of the keyway is preferably provided with angled guides or chamfers 22, 204*a,b*. Wheel guides 24*a*, 24*b* preferably with angled leading edges guide, e.g., the outboard wheels of the bins 14*a*, 14*b* to properly position the bins within the space 12.

As seen in FIG. 1, the interior surface of the lid of the bin 26 is substantially flat, except the ends of bolts, rivets or other fasteners 28 and the opening 32, thus avoiding undesirable incursion into the interior volume of the bin 14*b*. Further, as seen in FIG. 1, the interior of the bin 14*b* is not exposed to any moving parts other than the sliding door or covering of the opening 32. Although, for clarity, FIG. 1 shows the second bin 14*b* in the open configuration with the lid 26 upright, it is contemplated that normally, the lid 26 would not be opened in the vicinity of the coin counting device but would typically only be opened at a central coin processing facility, bank or the like.

Bins 14*a*, 14*b* include a number of features to facilitate safe transportation of the bins even when fully loaded. The bins are provided with rear wheels 34*a,b* but the front edges are supported by stop feet 36 *a–d* which are preferably made of or covered with a non-marking and/or non-staining material. In this way, the bins may be easily moved by slightly tipping backwards 38, e.g. through engaging the socket 42 of a hand truck 44 with a ball hitch 46 mounted on the bin 14*b* so that the stop feet 36*c*, 36*d* are raised above the support surface, permitting the bin 14*b* to be moved via wheels 34 and the hand truck wheels 48*a,b*. However, when hand truck 44 is released (permitting the stop feet 36*c*, 36*d* to contact the support surface), stop feet 36*c*, 36*d* provide a braking effect. In this way, if there is danger of the bin 14*b* going out of control, the operator may merely release the hand truck 44 causing the feet 36*c*, 36*d* to fall to the ground and brake movement of the bin 14*b*.

In the depicted embodiment, the bins are also provided with eyes 52*a–d*, e.g. for lifting the bins via a crane, boom or the like. When the lid 26 is in the closed position, as shown for bin 14*a*, the lid is locked, e.g. using a conventional hasp and lock device 54. To facilitate unloading of coins from the bins, an unloading opening 58 is provided in a lower portion of a wall of the bin such as the front wall. Preferably, the lower surface of the bin 62 slopes toward this opening to provide gravity feed. When the bin is not being unloaded, the opening 46 is closed by a plate-like gate 66 held in position, e.g. by an internal rail system (not shown). Preferably the gate 66 is in a contrasting color (compared to the exterior of the bin) to alert operators when the gate 66 is covering the opening 46 and avoid a situation in which a bin is installed in a coin handling machine without the covering 66 in place. The bins 14*a*, 14*b* may be provided with reflective and/or contrasting patches 68, e.g. to avoid collisions or other accidents, particularly in nighttime or dark conditions.

In the depicted embodiment the bins are provided with a pocket 72 or other receptacle for holding written or printed information identifying the bin and/or its contents or history. It is also possible to provide an embodiment in which information regarding the bin, its contents or history is stored electronically. A bin can be provided with electronically, optically or machine-readable indicia which uniquely identify the bin. In one embodiment, information about the bin (such as the date and time it is docked or undocked, the identity of the machine with which it is docked, the number of coins and/or value placed into the bins, the times it is emptied, locked, unlocked, the identification number or other identifier of persons accessing the bin, and the like) is sent to a central facility, e.g. over a telephone line, using a modem coupled to the computer or other control device 1874 for storage at a central location, such as a central computer. In another embodiment, information can be electronically stored on a chip or other electronic storage device 802, preferably battery-powered 804, which resides on or is coupled to the bin, for recording or storing information about the identity, condition, history or contents of the bin such as information regarding how full the bin is, which location or coin handling device it was connected with in the past, dates and times of docking and undocking, and other information for providing an electronic audit trail and/or accomplishing or facilitating electronic deposit and reconciliation of accounts. In one embodiment, a communications link, such as a wire or a wireless link (e.g. an infrared link) is provided for transferring information from the coin-handling device (such as the identity of the coin-handling device, times, numbers or value of coins placed in the bins or the like) to the bins, e.g. for storage.

Figure 2:
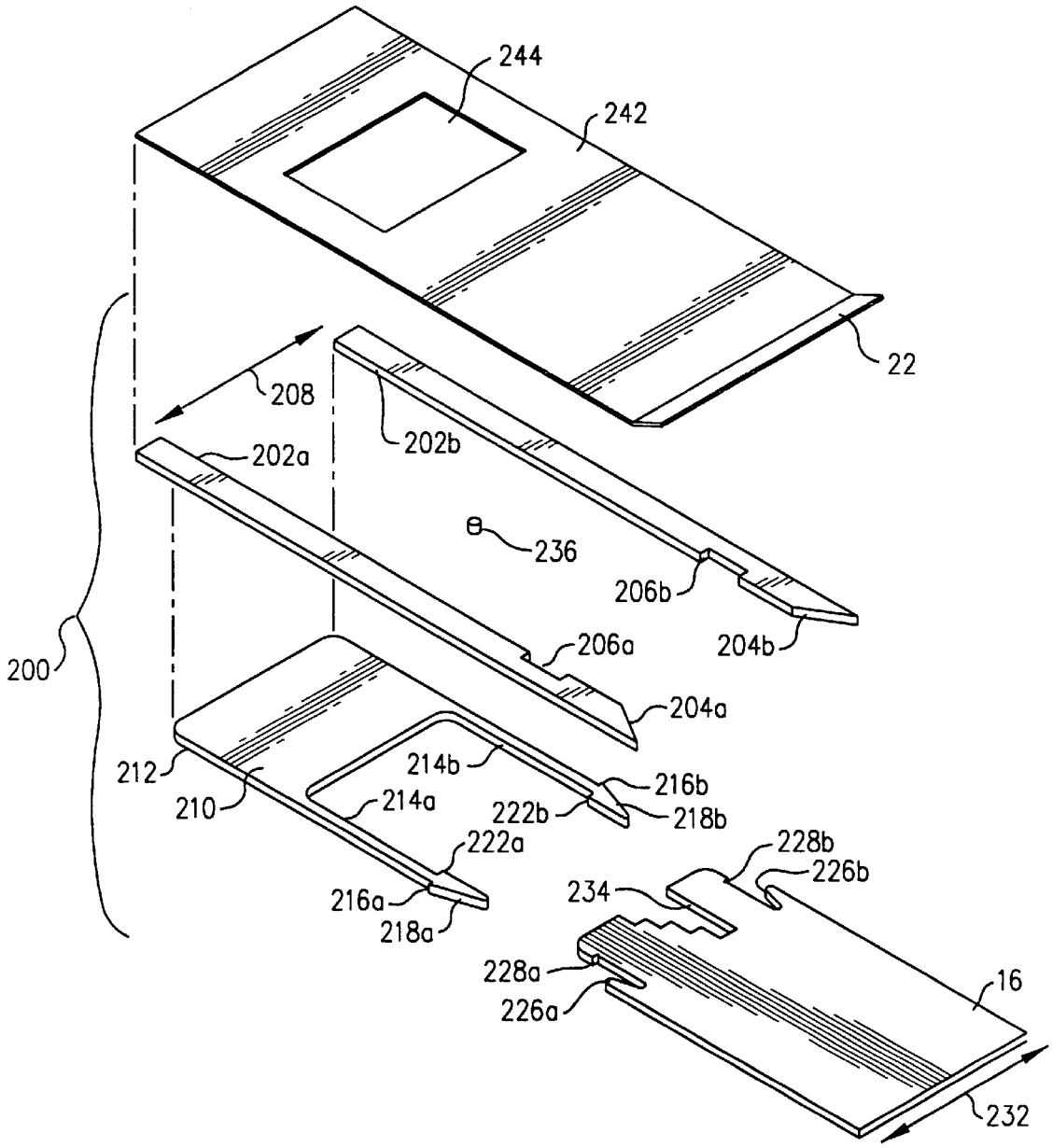
FIG. 2 is an exploded perspective view of a key and lock mechanism according to an embodiment of the present invention.

As shown in FIG. 2, the cover and locking mechanism and corresponding key 200 include left and right channel rails 202*a,b* having chamfered leading edges 204*a,b* and with first and second detents 206*a,b* formed therein. The rails 202*a,b* are positioned apart a distance 208 sufficient to accommodate the body portion 210 of a cover 212. The cover 212 includes first and second arms 214*a,b*. The terminal portions of the arms 214*a*, 214*b* define first and second teeth 216*a,b*, cam followers 218*a,b* and shoulders 222*a,b* for purposes to be described below. The key 16 includes first and second cams 226*a*, 226*b* configured to engage the cam followers 218*a*, 218*b* and first and second recesses 228*a*, 228*b*, configured to engage the first and second shoulders 222*a*, 222*b* in a manner to be described more fully below. The key 16 has a width 232 such that the key may slide between the channel rails 202*a*, 202*b*. A slot 234 is provided on a leading edge at the sides in position to receive a stop pin 236. The rails 202*a*, 202*b* and the cover 212 can be formed of a number of materials including plastic, metal, fiberglass, ceramic and the like. Opaque material is desirable for the cover 212 to make the locking mechanism non-visible from the outside of the closed container.

Preferably a cover plate 242 is positioned over the lock and key mechanism 200 to protect the mechanism from dirt, damage or tampering. Preferably the channel cover 242 is formed of an opaque material to conceal the configuration and operation of the lock and key mechanism. In one embodiment, cover 242 is made of a metal such as steel. The cover 242 includes an opening 244 aligned with the opening 32 in the lid 26 for permitting passage of coins therethrough.

Figure 3:
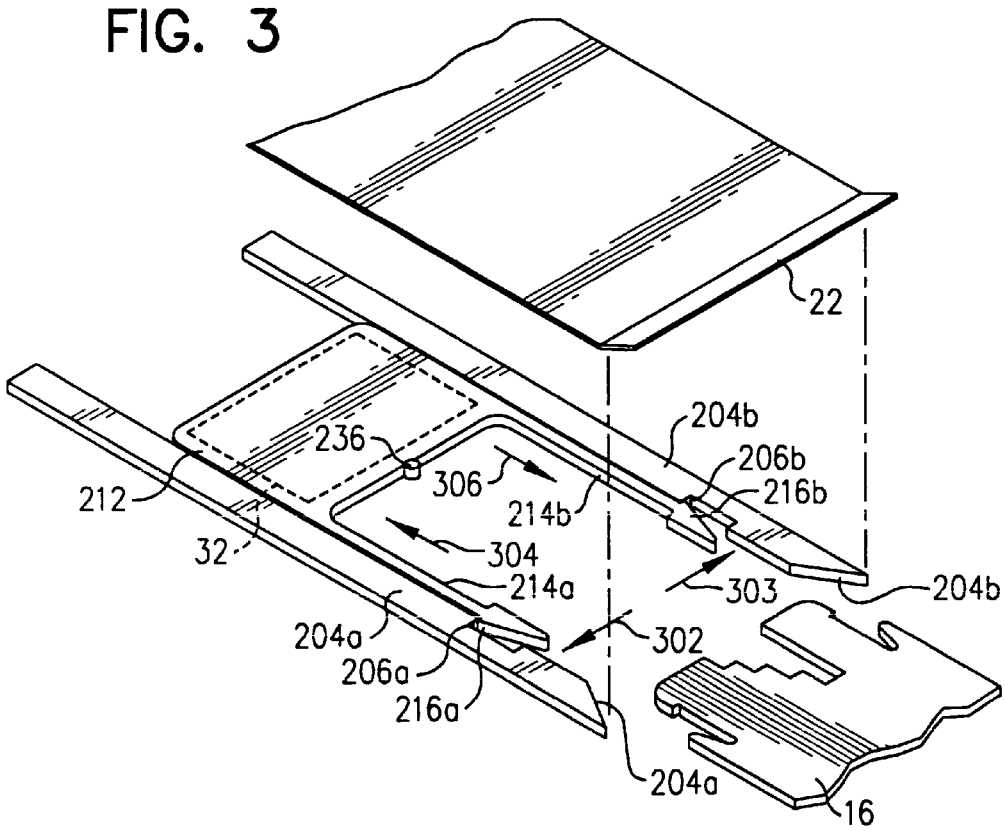
FIG. 3 is a partially exploded perspective view of the mechanism of FIG. 2 as the key is being first inserted.

In use, an empty or partially empty bin 14*a* is moved into the space 12, e.g. using the hand truck 44, with the wheel guide 24*a* forcing the bin 14*a* into a position such that the key 16*a* mounted in the space 12 is aligned with the keyway defined between the rails 202*a*, 202*b*. Any minor misalignment is accommodated by the chamfered or beveled edges of the key 16*a*, the resilient spring-like mounting arm 18*a*, 18*b*. The keys 16*a*, 16*b* are guided into the keyways, as the bins are positioned in the space 12, by the angled surfaces 22, 204*a*, 204*b*, as seen, e.g., in FIG. 3. As shown in FIG. 3, prior to insertion of the key 16, the body portion of the cover 212 is positioned over the opening 32 in the lid 26 of the bin. The arms 214*a*, 214*b* of the cover are constructed so as to be normally resiliently urged outward toward the rails 302, 303 so that the teeth 216*a*, 216*b* engage the edges of the detents 206*a*, 206*b* respectively in the rails preventing motion of cover 212 in an opening or first direction 304. The stop pin 236 abuts an edge of the cover 212 to prevent movement of the cover in a second, opposite direction 306.

Figure 4:
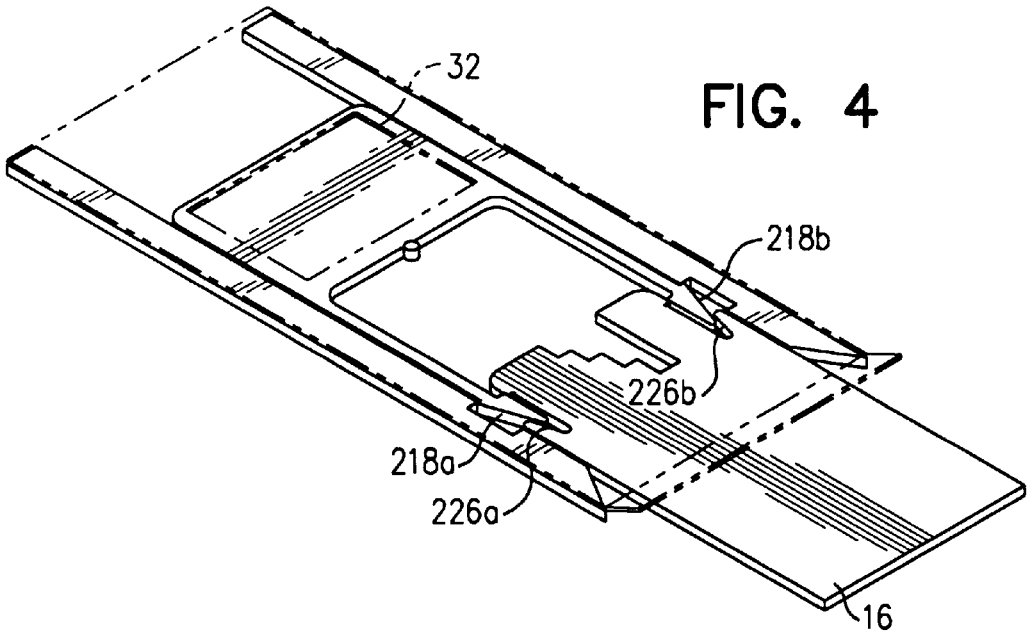
FIG. 4 is a perspective view corresponding to that of FIG. 3 but showing the key in a partially inserted position.
Figure 5:
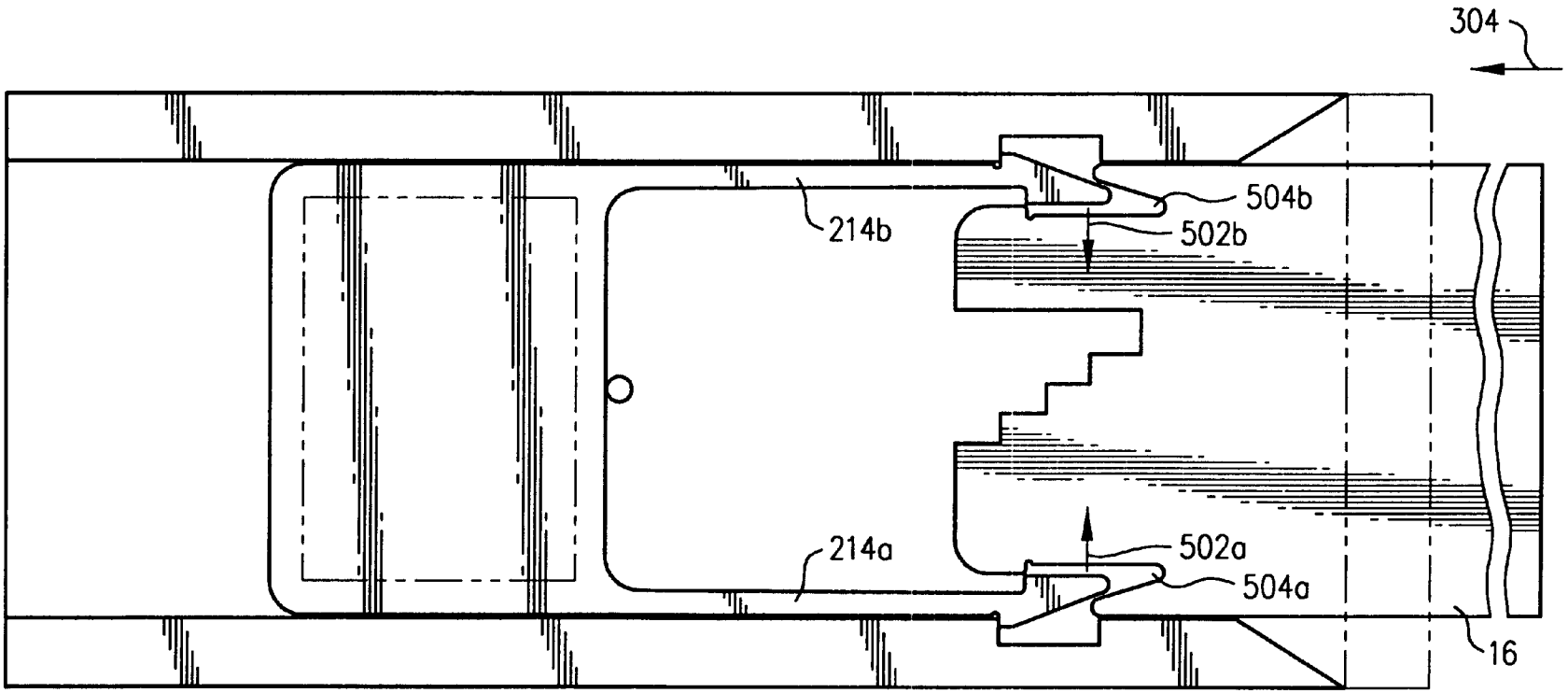
FIG. 5 is a top plan view of the lock and key mechanism depicted in FIG. 4.
Figure 6:
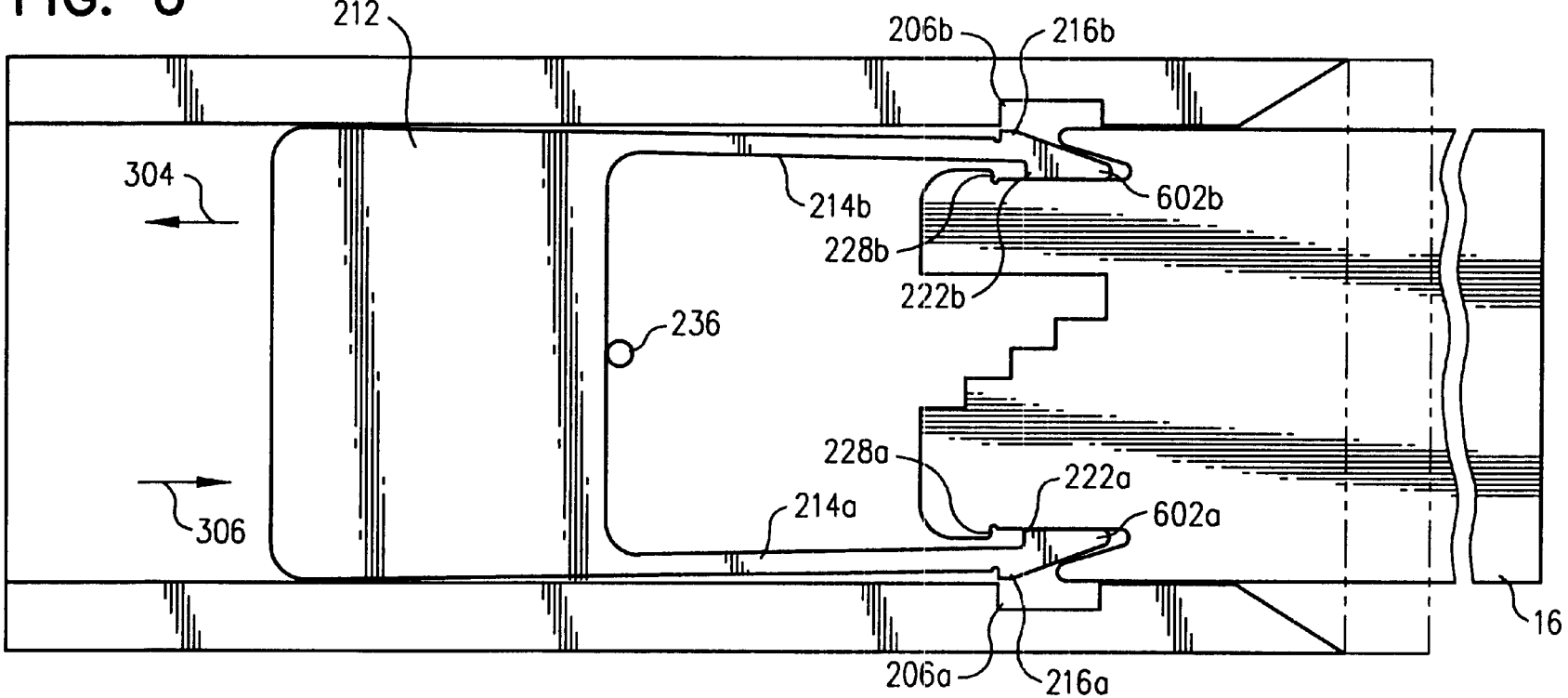
FIG. 6 is a top plan view corresponding to the view of FIG. 5 showing the key further inserted.
Figure 7:
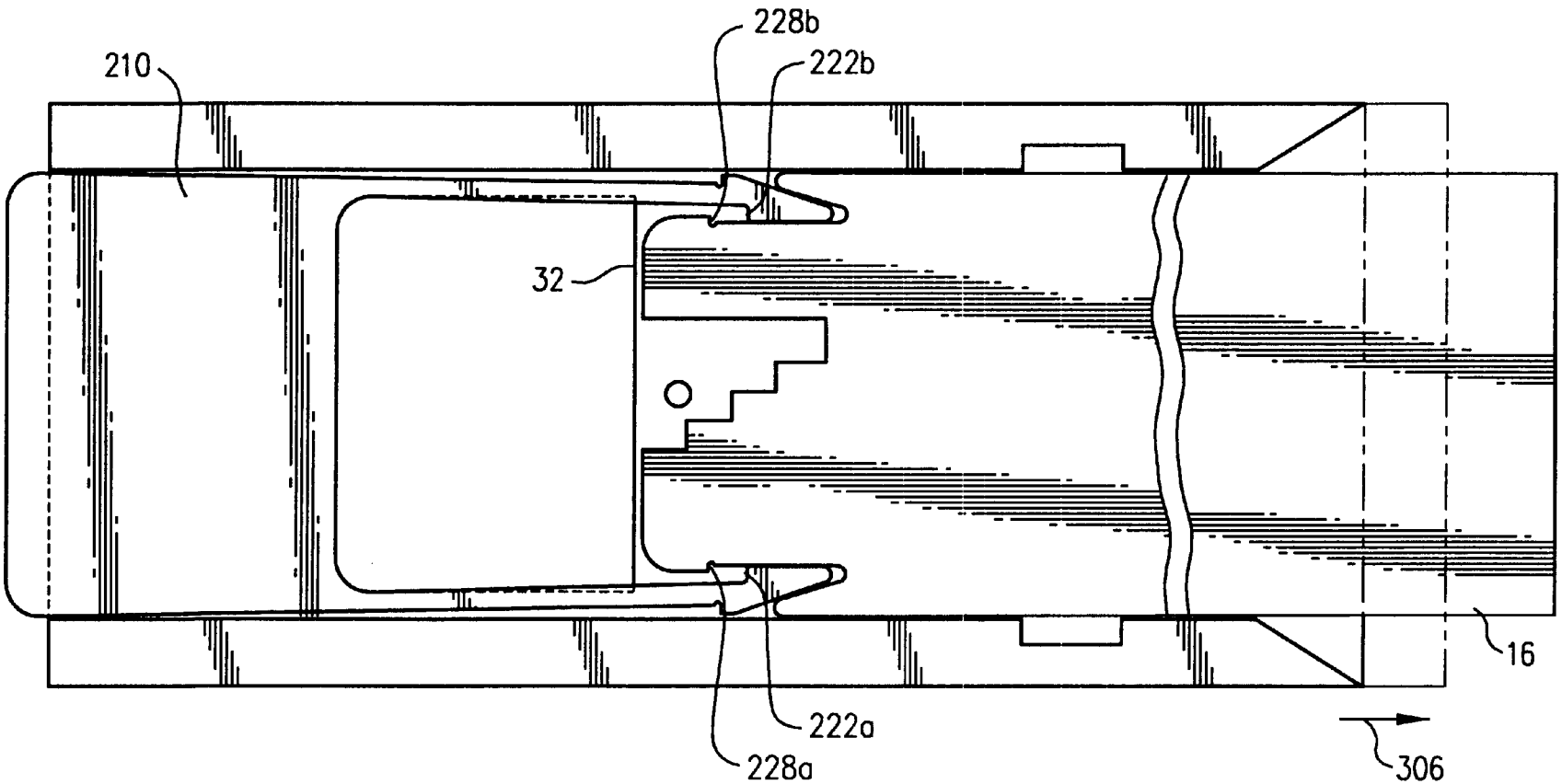
FIG. 7 is a top plan view corresponding to that of FIG. 6 but showing the key fully inserted and the cover in the open position.
Figure 8:
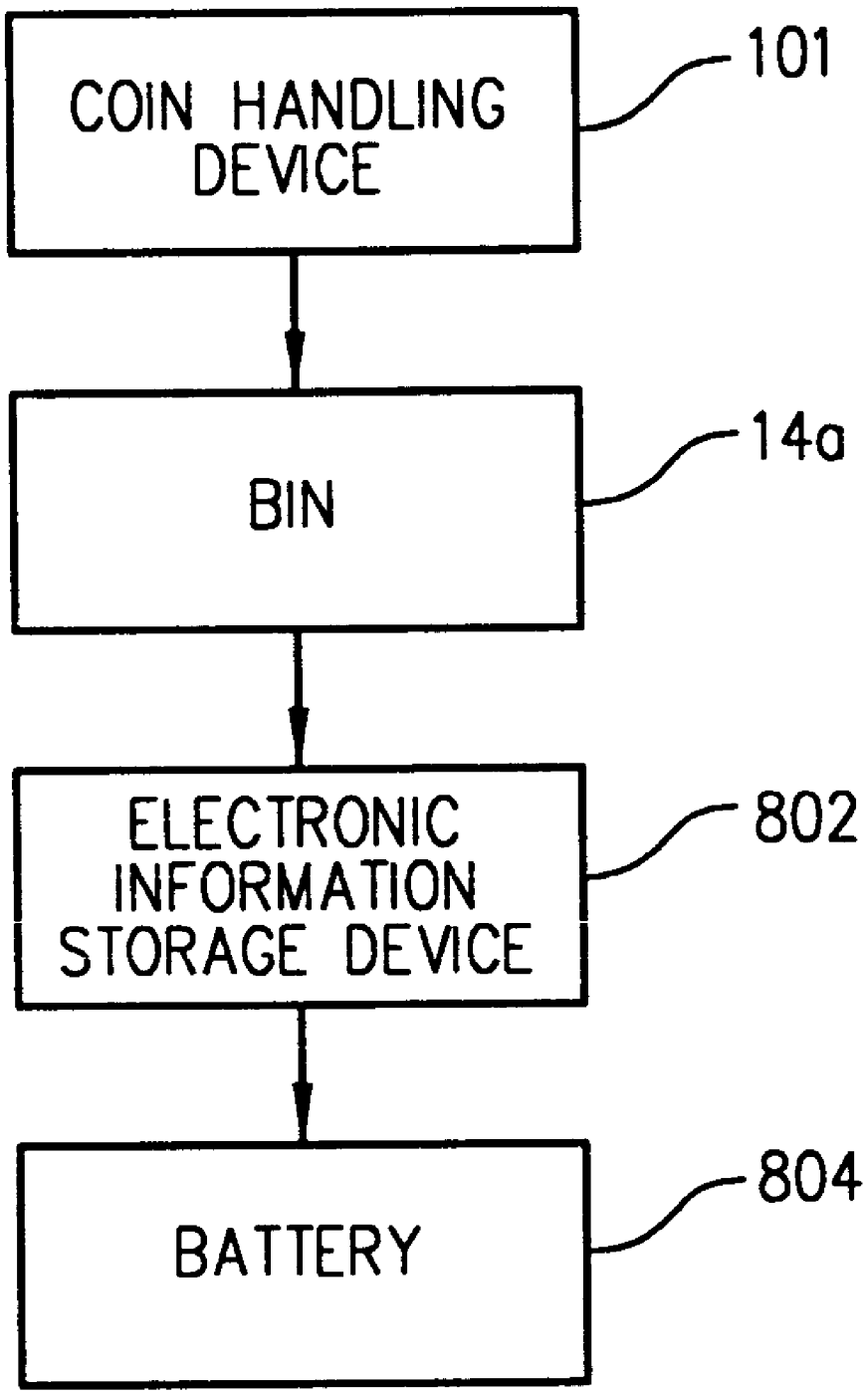
FIG. 8 is a schematic representation of a removable coin bin apparatus having an electronic information storage device according to an embodiment of the present invention.

As depicted in FIG. 4, upon further insertion of the key 16, the camming surfaces of the key contact the cam follower surfaces of the arms 218*a*, 218*b*. As shown in FIG. 5, further insertion of the key 16 in the opening direction 304 will create an inwardly-deflecting force 502*a*, 502*b* on the arms 214*a*, 214*b* causing the ends of the arms to move toward the configuration depicted in FIG. 6 in which the teeth 216*a*, 216*b* have cleared the detents 206*a*, 206*b*. Preferably, as shown in FIG. 6, the thus-deflected arms are thereby positioned so that the shoulders 206*a,b* are aligned for engagement with the recesses 228*a*, 228*b* respectively and/or the opening 602*a*, 602*b* of the arms 214*a*, 214*b* are engaged with the pockets 504*a*, 504*b* formed at the end of the camming surface of the key 16. In this manner, the key 16 and cover 212 will move substantially together through the channel since relative motion of the cover 12 with respect to the key 16. Therefore, as the key 16 is further inserted in the keyway (owing to continued insertion of the bin 14*a* into the space 12), the cover 212 is forced in the opening direction 304 to the position depicted in FIG. 7, uncovering the opening 32, as desired. Accordingly, when the bin 14*a* is inserted into the opening 12, the corresponding key 16*a* is inserted into the keyway of the bin 14*a* unlocking the cover and causing the cover to move to the open position automatically, i.e., without the need for human manipulation of the cover or lock.

When the bin 14 is withdrawn from the space 12, the process is essentially reversed. Upon withdrawal, the key 16 is withdrawn in the closing direction 306 and eventually the recess 228*a*, 228*b* contacts the shoulders 222*a*, 222*b* so that further withdrawal of the key 16 pulls the cover 210 through the channel in the closing direction 306. The cover 210 is eventually pulled to the configuration depicted in FIG. 6 whereupon the cover 212 contacts the stop pin 236 preventing further movement of the cover 212 in the closing direction 306. Continued withdrawal of the key 16 from the keyway (owing to continued withdrawal of the bin 14 from the space 12) allows the arms 214*a*, 214*b* to resiliently move back into the locking position depicted in FIG. 5 so that the cover is placed in the closed and locked position. Continued withdrawal of the key 16 from the keyway permits the bin 14 to be freely removed from the coin handler with the cover in a closed and locked position.

In light of the above description, a number of advantages of the present invention can be seen. The present invention provides a coin bin which is automatically closed and locked upon withdrawal from a coin handling device and is automatically opened and unlocked on insertion into a coin handling device. The present invention thus avoids unauthorized access to the contents of the bin with use of hands or simple tools (i.e., ordinary household tools such as pliers, screwdrivers, wrenches, and the like). The device is closed upon withdrawal of the bin and thus will not release coins in the event of tipping or upset. The closing and locking functions are provided without substantial incursion on the interior volume of the bin so that little or no volume is lost to achieve these functions. The device can be constructed with a small number of parts to reduce construction design, maintenance and other costs. Because of the capture of the cover by the key, attempts to block the cover from closing as the bin is removed will prevent the bin from being fully withdrawn from the coin handling device. Preferably, the key is permanently mounted (i.e., is non-removable from coin handling device) so that keeping track of keys and matching keys to trolleys or bins is not necessary. The preferred device operates entirely mechanically and requires no electrical parts. The device operates automatically upon insertion of the bin into or withdrawal of the bin from the coin handling device, and no manual operation, no cocking and no resetting are required. The device is sized and configured to be compatible with, and retrofitable in previous coin handling machines with little, preferably minimal or no, reconfiguration expense.

A number of variations and modifications of the present invention can also be used. It is possible to use some facets of the invention without using others. For example, it is possible to provide a device which provides for automatic opening and/or automatic closing without automatic locking or unlocking. Similarly, it is possible to provide a device which achieves automatic locking and/or unlocking without automatic opening or closing. Although the invention has been described in the context of an embodiment in which the interior of the bin defines a single space, it is also possible to use the present invention in connection with a bin or trolley which defines, in its interior space, multiple subspaces such as different spaces for different denominations or for holding coin bags or other containers therein. Although the depicted embodiment shows a bin with a single coin-entry opening, it is possible to use the present invention in connection with a bin having multiple coin-entry openings (e.g. for different denominations). Although the depicted embodiment provides for automatic operation of both insertion and withdrawal of the bin, it is possible to devise a bin which requires some manual manipulation to open the covering before inserting into a coin counting machine or requires some manipulation to close or lock the cover upon withdrawal. Although the depicted embodiment shows a single key system for each bin, it is possible to devise a system which requires insertion of two or more keys for operation. In one embodiment, it is possible to configure the coin handler so that it receives information regarding whether the opening of the bin is covered or uncovered and/or is properly aligned with an output chute (e.g. to avoid misdirecting counted coins). In the depicted device, the key achieves both the locking function and the opening function. However, it is possible to structure a device in which the key achieves one but not both of these functions.

Although it is preferred to provide a fully mechanical system, it is also possible to provide fully or partially electronic locks and keys. Although a particular lock and key configuration has been depicted, other configurations can be used such as positioning the teeth, camming surfaces, shoulders, recesses in different locations on the key and cover. It is possible to reverse the roles of the (male) key and (female) keyway and/or to reverse the relative positions of cams, cam followers, teeth, detents, recesses and the like.

Although the present invention has been described by way of a preferred embodiment and certain variations and modifications, other variations and modifications can also be used, the invention being defined by the following claims.

What is claimed is:

1. A removable coin bin apparatus usable in a coin-handling device, said coin-handling device defining at least a first bin position the apparatus comprising:

a bin having at least a first opening;

a cover for said opening, slidably movable from a closed position substantially covering said opening, to an open position, at least partially uncovering said opening to permit items to be placed into the interior of said bin through said opening;

at least a first lock movable from a locking configuration to maintain said cover in said closed position to an unlocked configuration, permitting movement of said cover to said open position, wherein said lock is integral to said cover;

at least a first key mounted in a first key position with respect to said coin handling device such that when said bin is placed in said first bin position, said first lock is automatically placed in said unlocked configuration, and said first key is coupled to said cover such that movement of said key relative to said bin pushes or pulls said cover between said open and closed positions.

2. A removable coin bin as claimed in claim 1, said bin having an opening adjacent a lower portion thereof for removal of coins, with a plate configured to removably cover said opening with means for visually signaling on the exterior of said bin whether said plate is in place, covering said opening.

3. A bin as claimed in claim 2 wherein said means for visually signaling includes providing a visible portion of said cover with a color contrasting that of surrounding portions of said bin exterior surface.

4. A removable coin bin apparatus as claimed in claim 1 the apparatus further comprising:

an electronic information storage device coupled to said bin.

5. A removable coin bin apparatus, as claimed in claim 4, wherein said electronic information storage device is configured to automatically store information selected from the group consisting of a docking time, an undocking time, an identifier of said coin-handling device, a number of coins and a value of bin contents.

6. A removable coin bin apparatus as claimed in claim 4, wherein said electronic information storage device is battery-powered.

7. A removable coin bin apparatus as claimed in claim 4, further comprising a communications channel configured to transfer information from said coin-handling device to said bin for storage in said electronic information storage device.

8. A removable coin bin apparatus usable in a coin-handling device, said coin-handling device defining at least a first bin position the apparatus comprising:

a bin having at least a first opening a cover for said opening, movable from a closed position substantially covering said opening, to an open position, at least partially uncovering said opening to permit items to be placed into the interior of said bin through said opening;

a first keyway positioned in said bin for receiving a key coupled to said coin-handling device at least a first lock movable from a locking configuration to maintain said cover in said closed position to an unlocked configuration permitting movement of said cover to said open position wherein said lock and said cover lie in the same plane;

at least a first key mounted in a first key position with respect to said coin handling such that when said bin is inserted in said first bin position, a detent coupled to said cover is engaged with said key wherein insertion of said key a first distance along said keyway pushes said cover toward said open position.

9. A removable coin bin apparatus as claimed in claim 8 wherein when said bin is removed from said first bin position, said lock is automatically placed in said locking configuration.

10. A removable coin bin apparatus as claimed in claim 8 wherein, when said bin is removed from said first bin position, said cover is automatically moved to said covered position.

11. A removable coin bin apparatus as claimed in claim 8 wherein when said bin is removed from said first bin position, said cover is automatically moved to said closed position and said lock is automatically placed in said locking configuration.

12. A removable coin bin apparatus usable in a coin-handling device, said coin-handling device defining at least a first bin position the apparatus comprising:

a bin having at least a first opening;

a cover for said opening, movable from a closed position substantially covering said opening, to an open position, at least partially uncovering said opening to permit items to be placed into the interior of said bin through said opening;

at least a first lock comprising at least a first arm fixed to said cover and resiliently movable from a locking configuration to maintain said cover in said closed position to an unlocked configuration, permitting movement of said cover to said open position;

a first keyway positioned in said bin;

at least a first key mounted in a first key position with respect to said coin handler such that when said bin is placed in said first bin position, said key is automatically inserted in said keyway, wherein said key has a camming surface to unlock said lock, wherein said cover is coupled to a detent such that, when said cover is in said open position and said key is inserted in said keyway, said detent is engaged with said key wherein withdrawal of said key a first distance along said keyway pulls said cover toward said closed position.

13. Apparatus, as claimed in claim 12, wherein when said key is inserted at least a first distance in said keyway, said lock is moved to said unlocked position.

14. Apparatus, as claimed in claim 12, wherein when said key is inserted at least a first distance in said keyway, said cover moved to said uncovered position.

15. Apparatus, as claimed in claim 12, wherein when said key is at least partially withdrawn from said keyway, said cover is placed in said covering position.

16. Apparatus, as claimed in claim 12, wherein when said key is at least partially withdrawn from said keyway, said lock is moved to said locking configuration.

17. Apparatus, as claimed in claim 12, wherein said cover is coupled to at least a first leg having at least a first tooth, said first leg is positioned such that when said cover is moved to said closed position, said first tooth is aligned with a first recess and wherein, when said tooth is aligned with said recess, said first tooth is urged into engagement with said first recess to lock said cover in said closed position.

18. Apparatus, as claimed in claim 17, wherein said cover is further coupled to a second leg having a second tooth, spaced a first distance from said first leg said second leg positioned such that when said cover is moved to said closed position, said second tooth is aligned with a second recess and wherein, when said second tooth is aligned with said second recess, said second tooth is urged into engagement with said second recess.

19. Apparatus, as claimed in claim 18, wherein said first distance is sufficiently large that it is infeasible to simultaneously disengage both said first and said second teeth using ordinary hand tools.

20. Apparatus, as claimed in claim 17, wherein said key is configured to disengage at least said first tooth from said first recess, when said key has been inserted at least a minimum distance into said keyway.

21. Apparatus as claimed in claim 17, wherein said urging of said first tooth into engagement with said first recess is caused by the resiliency of said leg, coupled to said cover.

22. Apparatus as claimed in claim 12 wherein at least a first portion of said cover is positioned in a portion of said keyway, when said cover is in said closed position, and wherein when said key is inserted at least a first distance into said keyway, a first portion of said key contacts at least said first portion of said cover and wherein further insertion of said key into said keyway, causes said first portion of said key to push said cover toward said open position.

23. Apparatus, as claimed in claim 12, wherein when said cover is moved to said closed configuration, said detent is urged out of engagement with said key, permitting said key to be further withdrawn along said keyway without further moving said cover.

24. Apparatus, as claimed in claim 12, wherein said bin is supported on a support surface by at least a first wheel and at least a first foot, such that said bin may be tipped to lift said foot from contact with said support surface for moving said bin using at least said first wheel and wherein contact of said foot with said support surface resists movement of said bit with respect to said support surface.

25. Apparatus, as claimed in claim 24 wherein said foot includes a substantially non-marking high friction substance.

26. Apparatus, as claimed in claim 12 wherein said bin has interior surfaces defining an interior volume of said bin and wherein said cover and lock are positioned to substantially avoid extending into said interior volume.

27. Apparatus, as claimed in claim 12, wherein said bin has interior surfaces defining an interior volume of said bin and wherein substantially no moving parts of said cover, lock or key are exposed to said interior volume.

28. Apparatus, as claimed in claim 12, wherein at least portions of said keyway are chamfered to guide said key into said keyway.

29. Apparatus, as claimed in claim 12, wherein at least portions of said key are chamfered to guide said key into said keyway.

30. Apparatus, as claimed in claim 12, further comprising at least a first lifting eye coupled to said bin.

31. Apparatus, as claimed in claim 12, further comprising at least a first ball hitch coupled to said bin.

32. Apparatus, as claimed in claim 31, wherein said ball hitch is configured for engagement with a hand truck.

33. A removable coin bin apparatus usable in a coin-handling device, said coin-handling device defining at least a first bin position the apparatus comprising:

a bin having at least a first opening a cover for said opening, movable from a closed position substantially covering said opening, to an open position, at least partially uncovering said opening to permit items to be placed into the interior of said bin through said opening;

at least a first lock movable from a locking configuration to maintain said cover in said closed position to an unlocked configuration, permitting movement of said cover to said open position;

a first keyway positioned in said bin;

at least a first key mounted in a first key position with respect to said coin handler such that when said bin is placed in said first bin position, said key is automatically inserted in said keyway wherein said cover is coupled to a detent such that, when said cover is in said open position and said key is inserted in said keyway, said detent is engaged with said key wherein withdrawal of said key a first distance along said keyway pulls said cover toward said closed position; and said key is resiliently mounted in said first key position.

34. A self-locking apparatus for a bin, said bin having a top with an opening therein, said apparatus comprising:

a first channel formed in said top of said bin and adjacent said opening, said first channel defining first and second recesses spaced from said opening;

a cover plate shaped to move in said channel from a closed position covering said opening to an open position spaced from said opening, said cover plate having first and second spaced-apart arms, having first and second tabs, respectively, positioned to be aligned with said first and second recesses, respectively, when said cover plate is in said closed position, said arms being resilient such that when said tabs are aligned with said recesses, said tabs are urged into said recesses to engage said recesses of said channel and said arms being sufficiently deflectable to permit said arms to be deflected so as to disengage said tabs from said recesses, said first and second arms further defining first and second cam follower surfaces, respectively;

a key shaped to move in said channel and defining first and second cam surfaces configured to engage said first and second cam follower surfaces of said first and second arms of said cover plate, respectively, wherein when said cover plate is in said closed position, as said key is moved in said channel in a direction toward said cover plate, said cam surfaces of said key engage said first and second cam followers such that, on further movement of said key toward said cam plate, said cams force said cam followers to move in such a fashion as to deflect said resilient first and second arms to disengage said first and second tabs from said first and second recesses, and wherein further movement of said key in a direction toward said cover plate pushes said cover plate toward said open position.

35. A removable coin bin apparatus usable in a coin-handling device, said coin-handling device defining at least a first bin position, the apparatus comprising:

a bin having at least a first opening;

a cover for said opening, movable from a closed position substantially covering said opening, to an open position, at least partially uncovering said opening to permit items to be placed into the interior of said bin through said opening;

a first keyway positioned in said bin for receiving a key coupled to said coin-handling device;

at least a first lock means integral to said cover and movable from a locking configuration for maintaining said cover in said locking position to an unlocked configuration for permitting movement of said cover to said open position;

means for automatically positioning said cover when said bin is placed in said first bin position by engaging a detent coupled to said cover, with said key, wherein insertion of said key a first distance in said keyway pushes said cover toward said open position.

36. A removable coin bin apparatus as claimed in claim 35, further comprising means for automatically unlocking said cover when said bin is placed in said first bin position, permitting movement of said cover to said open position.

37. A removable coin bin apparatus as claimed in claim 35, further comprising means for automatically moving said cover to said closed position when said bin is removed from said bin position.

38. A removable coin bin apparatus as claimed in claim 35, further comprising means for automatically locking said cover in said closed position when said bin is removed from said bin position.

39. Coin handling apparatus, comprising:

a frame;

a coin discriminator, coupled to said frame, configured to receive a plurality of coins, determine the value of said plurality of coins, and output said plurality of coins to at least a first output chute;

a bin having at least a first opening, said bin configured to fit in a first bin position wherein said first opening is substantially aligned with said first output chute;

a cover for said opening, movable from a closed position substantially covering said opening, to an open position, at least partially uncovering said opening to permit items to be placed into the interior of said bin through said opening;

at least a first lock lying in the same plane as said cover and movable from a locking configuration to maintain said cover in said closed position to an unlocked configuration, permitting movement of said cover to said open position;

a first keyway positioned in said bin;

at least a first key mounted in a first key position with respect to said coin handler such that when said bin is placed in said first bin position, said key is automatically inserted in said keyway;

wherein said cover is coupled to a detent such that, when said cover is in said open position and said key is inserted in said keyway, said detent is engaged with said key wherein withdrawal of said key a first distance along said keyway pulls said cover toward said closed position.

40. Apparatus, as claimed in claim 39, further comprising at least a first guide means, coupled to said frame, for guiding said bin to said first bin position.

41. Coin handling apparatus, as claimed in claim 39 further comprising means for automatically locking said cover in said closed position when said bin is removed from said bin position.

42. A method for providing security for coins in a coin bin, for use with a coin discriminating machine, said machine defining at least a first bin position for receiving said coin bin, the method comprising the steps of:

providing a coin bin having a top with an opening covered by a movable cover plate;

mounting a key in a predetermined position with respect to said bin position;

inserting said coin bin in said bin position, wherein said key is substantially simultaneously inserted in a keyway formed in said coin bin;

engaging at least a portion of said key with a detent coupled to said cover plate, wherein said key unlocks a lock that is integral to said cover plate;

pushing said cover plate, in response to further movement of said key in said keyway, to at least partially uncover said opening;

withdrawing said bin from said bin position, wherein said key is substantially simultaneously withdrawn from said keyway and wherein said cover plate is substantially simultaneously pulled to a position substantially covering said opening; and automatically locking said plate in said position substantially covering said opening.

43. A method, as claimed in claim 42, further comprising inserting said coin bin in a bin position of a coin handling device, following said step of automatically locking said plate, wherein said plate is automatically unlocked and moved to the open position without the need for manually resetting.

44. A method for providing security for coins in a coin bin, for use with a coin discriminating machine, said machine defining at least a first bin position for receiving said coin bin, the method comprising the steps of:

providing a coin bin having a top with an opening covered by a movable cover plate;

mounting a key in a predetermined position with respect to said bin position;

inserting said coin bin in said bin position, wherein said key is substantially simultaneously inserted in a keyway formed in said coin bin, and wherein said key and said cover plate lie in the same plane;

engaging at least a portion of said key with a detent coupled to said cover plate;

pushing said cover plate, in response to further movement of said key in said keyway, to at least partially uncover said opening;

withdrawing said bin from said bin position, wherein said key is substantially simultaneously withdrawn from said keyway and wherein said cover plate is substantially simultaneously pulled to a position substantially covering said opening; and automatically locking said plate in said position substantially covering said opening.

45. A method for providing security for coins in a coin bin, for use with a coin discriminating machine, said machine defining at least a first bin position for receiving said coin bin, the method comprising the steps of:

providing a coin bin having a top with an opening covered by a movable cover plate, wherein said cover plate is locked in position by resilient arms integral to said cover plate;

mounting a key in a predetermined position with respect to said bin position;

inserting said coin bin in said bin position, wherein said key is substantially simultaneously inserted in a keyway formed in said coin bin;

engaging at least a portion of said key with said arms of said cover plate, wherein said key has a camming surface to move said resilient arms and to unlock said cover plate;

pushing said cover plate, in response to further movement of said key in said keyway, to at least partially uncover said opening;

withdrawing said bin from said bin position, wherein said key is substantially simultaneously withdrawn from said keyway and wherein said cover plate is substantially simultaneously pulled to a position substantially covering said opening; and automatically locking said plate in said position substantially covering said opening.

46. A removable coin bin apparatus usable in a coin-handling device, said coin-handling device defining at least a first bin position, the apparatus comprising:

a bin having at least a first opening;

a cover for said opening, movable from a closed position substantially covering said opening, to an open position, at least partially uncovering said opening to permit items to be placed into the interior of said bin through said opening;

a first keyway positioned in said bin for receiving a key coupled to said coin-handling device;

at least a first lock means integral to said cover and resiliently movable from a locking configuration for maintaining said cover in said closed position to an unlocked configuration for permitting movement of said cover to said open position wherein a camming surface on said first lock means moves said first lock means to said unlocked configuration when said key is received in said keyway;

means for automatically positioning said cover when said bin is placed in said first bin position by engaging a detent coupled to said cover, with said key, wherein insertion of said key a first distance in said keyway pushes said cover toward said open position wherein a camming surface on said first lock means moves said first lock means to said open position when said key is received in said keyway.

* * * * *